United States Patent [19]

Gemmill, Jr. et al.

[11] 4,396,517

[45] Aug. 2, 1983

[54] PHENOLIC-CONTAINING MANNICH BASES AND LUBRICANTS CONTAINING SAME

[75] Inventors: Robert M. Gemmill, Jr., Pitman; Andrew G. Horodysky, Cherry Hill, both of N.J.

[73] Assignee: Mobil Oil Corporation, New York, N.Y.

[21] Appl. No.: 291,651

[22] Filed: Aug. 10, 1981

[51] Int. Cl.[3] ..... C10M 1/20; C10M 1/32; C09F 7/00

[52] U.S. Cl. ..... 252/51.5 R; 252/51.5 A; 44/72; 260/404.5; 564/355; 564/373; 549/491; 549/498

[58] Field of Search ..... 44/72; 252/51.5 R; 564/355, 373; 260/347.7, 404.5 PA

[56] References Cited

U.S. PATENT DOCUMENTS

| | | | |
|---|---|---|---|
| 3,036,003 | 5/1962 | Verdol | 252/51.5 R X |
| 3,539,633 | 11/1970 | Piasek et al. | 252/51.5 R X |
| 3,725,277 | 4/1973 | Worrel | 252/51.5 R |
| 3,725,480 | 4/1973 | Traise et al. | 252/51.5 R X |
| 3,772,359 | 11/1973 | Schlobohm et al. | 260/404.5 PA |
| 3,798,165 | 3/1974 | Piasek et al. | 252/51.5 R |
| 3,798,247 | 3/1974 | Piasek et al. | 252/51.5 R X |
| 3,804,899 | 4/1974 | Ebnother et al. | 564/355 X |
| 4,025,316 | 5/1977 | Stover | 252/51.5 R X |
| 4,058,642 | 11/1977 | Renth et al. | 564/355 X |
| 4,157,308 | 6/1979 | Wilgus et al. | 252/51.5 R X |

*Primary Examiner*—Paul F. Shaver

*Attorney, Agent, or Firm*—Charles A. Huggett; Michael G. Gilman; Claude E. Setliff

[57] ABSTRACT

Reaction products from certain phenol, aldehydes and amines are effective friction reducing additives in lubricants and in liquid fuels, such as gasoline and alcohol fuels.

26 Claims, No Drawings

PHENOLIC-CONTAINING MANNICH BASES AND LUBRICANTS CONTAINING SAME

BACKGROUND OF THE INVENTION

1. Field of the Invention:

This invention relates to Mannich base lubricant and liquid fuel additives and to compositions thereof with such lubricants and fuels.

2. Discussion of the Prior Art:

A great deal of effort has been directed to providing a lubricant which will permit present-day automotive engines to be operated at a high level of efficiency over long periods of time. A difficulty arises because lubricating oils tend to deteriorate under the conditions of use, with attendant formation of sludge, lacquer, and resinous materials which adhere to the engine parts, thereby lowering the operating efficiency of the engine. To counteract the formation of these deposits, certain chemical additives have been found which, when added to lubricating oils, have the ability to keep the deposit-forming materials suspended in the oil, so that the engine is kept clean and in efficient operating condition for extended periods of time. These added agents are known in the art as detergents or dispersants.

One solution to the problem, as described in U.S. Pat. No. 3,368,972, involved the use of a conventional Mannich base made using a phenol containing a high molecular weight alkyl substituent. U.S. Pat. No. 2,459,114 also discloses the use of conventional Mannich bases, but made using short-chain alkyl-substituted hydroxyaromatics or a relatively high molecular weight straight chain chlorinated aliphatic hydrocarbon.

Another difficulty is that sliding or rubbing metal or other solid surfaces are subject to wear under conditions of extreme pressure. Wearing is particularly acute in modern engines in which high temperature and contact pressures are prevalent. Under such conditions, severe erosion of metal surfaces can take place even with present generation lubricants unless a load carrying or antiwear additive is present therein.

Friction is also a problem any time two surfaces are in sliding or rubbing contact. It is of especial significance in an internal combustion engine and related power train components, because loss of a substantial amount of the theoretical mileage possible from a gallon of fuel is traceable directly to friction. The Mannich bases of this invention unexpectedly are effective in decreasing this friction.

Mannich bases derived from phenols, aldehydes and amines are well known in the prior art. Those derived from high molecular weight phenols, formaldehyde and polyalkylenepolyamines (e.g., tetraethylenepentamine) are known for their dispersant abilities in lubricant and fuel formulations. No prior art, however, is known that discloses the preparation or utility of low molecular weight Mannich bases derived, for example, from para-tert-butylphenol or para-tert-octylphenol in combination with a relatively low molecular weight ($C_{10}$–$C_{20}$) monofunctional primary amine. This combination appears unique in that other small para-substituents (e.g. methyl, methoxy, $-CH_2NHR$) give products with much lower friction reducing ability. Primary amines with less than ten carbon atoms as well as secondary amines also give products with relatively low friction reducing ability.

Examples of Mannich condensation products may be found in U.S. Pat. No. 3,368,972 (lubricant compositions), U.S. Pat. No. 3,649,229 (fuel compositions), U.S. Pat. No. 4,006,089 (lubricant compositions), U.S. Pat. No. 4,025,316 (gasoline compositions) and U.S. Pat. Nos. 4,054,422 and 4,121,911 (fuel and lubricant compositions).

SUMMARY OF THE INVENTION

In accordance with the invention, there is provided a Mannich base reaction product made by reacting an aldehyde, an amine and one or more of a phenol of the formula

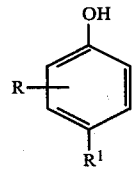

wherein R is preferably hydrogen, but can be a $C_1$ to $C_{30}$ hydrocarbyl group, which may be an alkyl, alkenyl, aryl, alkaryl or aralkyl group and $R^1$ is a tertiary hydrocarbyl group, preferably alkyl or alkenyl containing 4 to 20 carbon atoms. It will be understood that when "hydrocarbyl" or "tertiary hydrocarbyl" are referred to, it is meant to refer to R and $R^1$, respectively. In R, the aryl group can be one having from 6 to 14 carbon atoms, i.e. phenyl, naphthyl or anthryl.

The invention also provides lubricant and liquid fuel compositions containing an anticorrosion or antifriction amount of same. Liquid fuels include, for example, liquid hydrocarbon fuels, such as gasoline, diesel fuel and the like, and alcohols, such as methyl and ethyl alcohols.

DESCRIPTION OF SPECIFIC EMBODIMENTS

New and useful products effective as friction reducers when added to lubricants are made by reacting a phenol of the formula

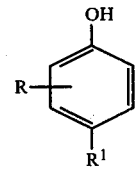

wherein R and $R^1$ are as already defined, with an aldehyde and an amine.

Representative phenols that may be used are p-tert-butylphenols, p-tert-octylphenol, p-tert-dodecylphenol, p-tert-hexadecylphenol, and the like.

Aldehydes contemplated by the present invention are the aliphatic aldehydes, typified by formaldehyde or paraformaldehyde, acetaldehyde, and aldol($\beta$-hydroxy butyraldehyde); aromatic aldehydes, such as benzaldehyde and heterocyclic aldehydes, such as furfural. The aldehyde may contain a substituent group such as hydroxyl, halogen, nitro and the like. In short, any substituent can be used which does not take a major part in the reaction. Preference, however, is given to the aliphatic aldehydes, formaldehyde being particularly preferred.

The amines contemplated herein are those which contain a primary amino group. Preferably, these include saturated and unsaturated aliphatic amines containing 1 to 20 carbon atoms. They more specifically include those disclosed hereinbelow as well as such typical amines as: polyalkylenepolyamines of the formula $$NH_2(R^2NH)_nH$$

wherein $R^2$ is an alkylene group having from 1 to 5 carbon atoms and n is from 1 to 10. Examples of these are ethylenediamine, propylenediamine, and the like. Cyclic amines are also contemplated and include cyclohexylamine and dicyclohexylamine.

The phenols used in this invention were purchased from commercial sources. In general, if desired or necessary, they can be prepared by reactions generally known to the art.

Reaction between phenol, amine and aldehyde is carried out at from about 80° C. to about 150° C. Reaction times are not critical, ranging from about 1 hour or less up to 8 or more hours, depending upon the particular reactants.

While the preferred mode of synthesis involves a one-step reaction in which all reactants are placed together, other modes can be used. For example, phenol and amine can be reacted to yield an ammonium phenate, and this product is then reacted with an aldehyde. This mode is not favorable, since one tends to get methylene bridged polymers. A third possible scheme involves the reaction of amine and aldehyde to yield a Schiff base ($RN{=}CH_2$), followed by reaction of the Schiff base with phenol to give the product. Results using this reaction are more favorable than the second scheme mentioned, and they appear to be similar to the first reaction.

The novel additives of the invention have been disclosed to be reaction products, not identifiable single compounds. While they are believed to be complex mixtures of all the possible products obtainable from any given reaction mixture, the products are believed to contain substantial or even predominant amounts of compounds as shown in the following illustrative reaction:

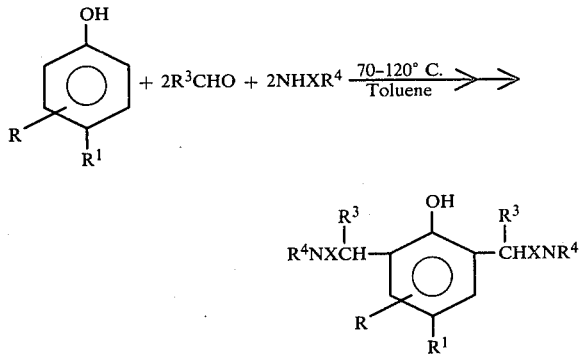

wherein R is hydrogen, $R^1$ is as described above, $R^3$ is a $C_1$ to $C_6$ alkyl group, but is preferably hydrogen (formaldehyde or paraformaldehyde), $R^4$ is a $C_6$ to $C_{28}$ aliphatic group, and X is hydrogen or $R^4$. Among the amines contemplated are cocoamine, oleylamine, octylamine, nonylamine, decylamine, cyclooctylamine, dodecylamine, tetradecylamine, hexadecylamine, octadecylamine, stearylamine, laurylamine and soyamine as well as other unsaturated counterparts thereof.

The additives can be used in a wide variety of systems at from about 0.1% to about 10% by weight preferably about 1.0% to about 4.0%.

Transmission fluids illustrate one system important to the present invention. These are blends of highly refined petroleum base oils combined with VI improvers, detergents, defoamants and special additives to provide controlled-friction or lubricity characteristics. Varied transmission design concepts have led to the need for fluids with markedly different frictional characteristics, so that a single fluid cannot satisfy all requirements. The fluids intended for use in passenger car and light-duty truck automatic transmissions are defined in the ASTM Research Report D-2:RR 1005 on "Automatic Transmission Fluid/Power Transmission Fluid Property and Performance Definitions" Specifications for low temperature and aircraft fluids are defined in U.S. Government Specification MIL-H-5606A. In addition, the oxidation and corrosion resistance of functional fluids such as hydraulic fluids can be improved by the adducts of the present invention.

Fully formulated lubricants can include phenates, sulfonates, succinimides, amides, imides, esters, zinc dithiophosphates, polymers, etc.

Of particular significance, in accordance with the present invention, is the ability of the additives to improve a variety of properties. They include the wear resistance or friction qualities of lubricated parts and to improve resistance to oxidation and corrosion of oleaginous materials such as lubricating media. These preferably comprise liquid oils, in the form of either a mineral oil or a synthetic oil or mixtures thereof, but also may be a grease in which any of the aforementioned oils are employed as a vehicle. In general, mineral oils, both paraffinic, naphthenic and mixtures thereof, employed as the lubricant, or grease vehicle, may be of any suitable lubricating viscosity range, as for example, from about 45 SUS at 100°F. to about 6000 SUS at 100° F., and preferably, from about 50 to about 250 SUS at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in greaseforming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where synthetic oils, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

The fuel compositions disclosed herein will contain from about 5 to about 500 pounds of additive per 1000 barrels of fuel, preferably about 20 to about 120 pounds per 1000 barrels.

It is to be understood that the compositions contemplated herein can also contain other materials. For example, other corrosion inhibitors, extreme pressure agents, antiwear agents, defoamants, detergents, dispersants, and the like can be used. These materials do not detract from the value of the compositions of this invention. Rather the materials serve to impart their customary properties to the particular compositions in which they are incorporated.

The following examples will illustrate the invention. They are illustrative only, and are not intended to limit the invention. In the formulas, R is COCO ($C_{13}$ average).

EXAMPLE 1

Di(mono-cocoamine) Mannich Base of p-t-Butylphenol

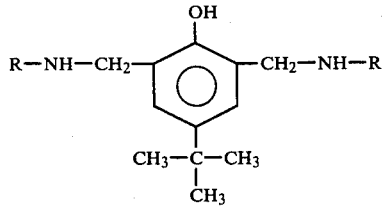

A 500 ml glass reactor fitted with a nitrogen inlet, stirrer, thermometer, Dean-Stark water trap and condenser was used for the reaction.

p-Tert-butylphenol (0.2 mole, 30.0 grams), paraformaldehyde (0.4 mole, 12.6 grams), cocoamine (0.4 mole, 84.0 grams) and 100 ml. of toluene were charged to the reactor.

The reaction mixture was heated, using a nitrogen blanket and rapid stirring, to a maximum temperature of 125° C. (reflux) for one hour. A total of 8.4 ml. of water (theory=7.8 ml.) was collected. The toluene was removed by vacuum distillation. The product was vacuum filtered through a diatomaceous clay filter aid at room temperature. The final Mannich base product was a clear, light amber, low viscosity fluid.

EXAMPLE 2

Di(mono-cocoamine) Mannich Base of p-t-Octylphenol

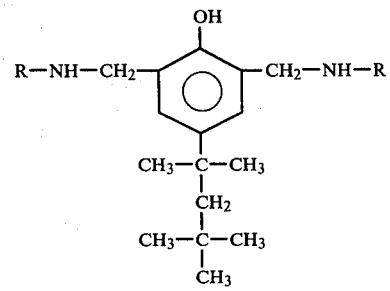

The reactor in Example 1 was used for this example.

Paraformaldehyde (0.4 mole, 12.6 grams), p-tert-octylphenol (0.2 mole, 41.2 grams), cocoamine (0.4 mole, 84.0 grams) and 100 ml of toluene were charged to the reactor.

The reaction mixture was heated, using a nitrogen blanket and rapid stirring, to a maximum temperature of 130° C. (reflux) for two hours. A total of 7.4 ml of water (theory=7.8 ml) was collected. The toluene was removed by vacuum distillation. The product was vacuum filtered through a diatomaceous clay filter aid at room temperature. The final Mannich base product was a clear, light amber, low viscosity fluid.

In general, the products of the Examples may be used in any amount which is effective for the desired activity. Broadly, the additive can be used in the lubricant at from about 0.1% to about 10.0% by weight.

EVALUATION OF THE COMPOUNDS

The compounds were evaluated in a low velocity friction apparatus (LVFA) in a fully formulated 5W-20 synthetic engine oil containing an additive package including antioxidant, dispersant and detergent.

Description

The Low Velocity Friction Apparatus (LVFA) is used to measure the coefficient of friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.2). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X–Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam-motor arrangement.

Procedure

The rubbing surfaces and 12–13 ml of test lubricants are placed on the LVFA. A 240 psi load is applied, and the sliding speed is maintained at 40 fpm at ambient temperature for a few minutes. Plots of coefficients of friction ($U_k$) vs. speed were taken at 240, 300, 400, and 500 psi. Freshly polished steel specimens are used for each run. The surface of the steel is parallel ground to 4 to 8 microinches. The results in Table 1 refer to percent reduction in coefficient of friction compared to the unmodified oil. That is, the formulation mentioned above was tested without the compound of this invention and this became the basis for comparision. The results were obtained at 250° F. and 500 psi.

Friction Reduction Evaluations
Low Velocity Friction Apparatus Bench Test (LVFA)

| | Additive Conc. Wt. % | % Reduction in the Coefficient of Friction at 5 Ft./Min. | 30 Ft./Min. |
|---|---|---|---|
| Test Oil | 0 | 0 | 0 |
| Example 1 | 1 | 16 | 16 |
| | 2 | 24 | 25 |
| | 4 | 26 | 30 |
| Example 2 | 4 | 20 | 25 |

The results clearly show the friction-reducing properties of these compositions relative to the base oil.

Copper Passivation Ability

The Mannich base of Example 1 was blended with 200″ solvent paraffinic neutral lubricating oil and was tested for copper corrosivity, using the general procedures as described in ASTM D130–80, at 250° F. for 3 hours and at 210° F. for 6 hours.

Copper Strip Corrosion Tests

| | Additive Concentration in 200″ SPN Wt. % | 250° F., 3 Hrs. Rating | 210° F., 6 Hrs. Rating |
|---|---|---|---|
| Example 1 | 1 | 1A | 1A |
| | 3 | 1A | 1A |

We claim:

1. A product of reaction made by reacting an aldehyde, cocoamine and at least one phenol of the formula:

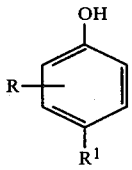

wherein R is hydrogen or a $C_1$ to $C_{30}$ hydrocarbyl group and $R^1$ is a tertiary hydrocarbyl containing 4 to 20 carbon atoms.

2. The product of claim 1 wherein said hydrocarbyl is alkyl, alkenyl, aryl, alkaryl or aralkyl and said tertiary hydrocarbyl is a tertiary alkyl or alkenyl.

3. The product of claim 1 wherein in preparing same the aldehyde is an aliphatic aldehyde.

4. The product of claim 3 wherein the aldehyde has the formula $R^3CHO$ in which $R^3$ is a $C_1$ to $C_6$ alkyl.

5. The product of claim 3 wherein the aldehyde is formaldehyde, paraformaldehyde, acetaldehyde, aldol, benzaldehyde, furfural or the substituted members thereof.

6. The product of claim 5 wherein the aldehyde is paraformaldehyde.

7. The product of claim 1 wherein the amine is cocoamine, the phenol is p-tert-butylphenol and the aldehyde is paraformaldehyde, in a mole ratio of 2:1:2, respectively.

8. The product of claim 1 wherein the amine is cocoamine, the phenol is p-tert-octylphenol and the aldehyde is paraformaldehyde, in a mole ratio of 2:1:2, respectively.

9. A lubricant or liquid fuel composition comprising a major proportion of a lubricant or fuel and an antifriction amount of the product of claim 1.

10. The composition of claim 9 wherein in preparing said product said hydrocarbyl is alkenyl, alkyl, aryl, alkaryl or aralkyl and said tertiary hydrocarbyl is a tertiary alkyl or alkenyl.

11. The composition of claim 9 wherein in preparing said product the aldehyde is an aliphatic aldehyde.

12. The composition of claim 11 wherein the aldehyde has the formula $R^3CHO$ in which $R^3$ is a $C_1$ to $C_6$ alkyl.

13. The composition of claim 11 wherein the aldehyde is formaldehyde, paraformaldehyde, acetaldehyde, aldo, benzaldehyde, furfural or the substituted members thereof.

14. The composition of claim 9 wherein in preparing the product the amine is cocoamine, the phenol is p-tert-butylphenol and the aldehyde is paraformaldehyde, in a mole ratio of 2:1:2, respectively.

15. The composition of claim 9 wherein in preparing the product the amine is cocoamine, the phenol is p-tert-octylphenol and the aldehyde is paraformaldehyde, in a mole ratio of 2:1:2, respectively.

16. The composition of claim 9 wherein said lubricant is a lubricating oil or a grease therefrom.

17. The composition of claim 9 wherein the lubricant is a mineral or synthetic lubricating oil or mixtures thereof.

18. The composition of claim 17 wherein the lubricating oil is a mineral oil.

19. The composition of claim 17 wherein the lubricating oil is a synthetic oil.

20. The composition of claim 17 wherein the lubricating oil is a mixture of mineral and synthetic oils.

21. The composition of claim 16 wherein the lubricant is a grease.

22. The composition of claim 9 wherein said fuel is a liquid hydrocarbon fuel or an alcohol fuel.

23. The composition of claim 22 wherein the liquid hydrocarbon fuel is gasoline.

24. The composition of claim 22 wherein the liquid hydrocarbon fuel is a diesel fuel.

25. The composition of claim 22 wherein the alcohol is methanol.

26. The composition of claim 22 wherein the alcohol is ethanol.

* * * * *